US005898940A

United States Patent [19]

Cameron

[11] Patent Number: 5,898,940

[45] Date of Patent: May 4, 1999

[54] COMBINED BIB AND BOTTLE SUPPORT

[76] Inventor: Elizabeth R. Cameron, 21263 Old North Church Rd., Frankfort, Ill. 60423

[21] Appl. No.: 09/075,441

[22] Filed: May 11, 1998

[51] Int. Cl.[6] ..... A41B 13/10

[52] U.S. Cl. ..... 2/49.1; 2/49.4; 2/48

[58] Field of Search ..... 2/46, 48, 49.1, 2/49.2, 49.3, 49.4, 49.5, 50, 51, 52, 75, 80, 83, 174, 69, 69.5, 104, 105, 106, 113, 114, 115

[56] References Cited

U.S. PATENT DOCUMENTS 298,985 5/1884 Kimball ..... 2/49.2
2,482,182 9/1949 Henninger ..... 2/48
4,473,907 10/1984 Maillard ..... 2/49.1
4,564,957 1/1986 Scharf ..... 2/49.2
5,312,282 5/1994 Cooper ..... 2/49.2

*Primary Examiner*—Jeanette Chapman
*Attorney, Agent, or Firm*—Edward D. Gilhooly, Ltd.

[57] ABSTRACT

A combined bib and bottle holder for a child having a front and rear panel sewn together and enclosing a soft material. An elastic loop is attached to the front panel for supporting a bottle. A pair of upper portions are formed on the front and rear panels for forming a neck hole.

4 Claims, 1 Drawing Sheet

COMBINED BIB AND BOTTLE SUPPORT

BACKGROUND OF INVENTION

1. Field of the Invention

This invention relates in general to infant accessories and, more particularly, to a combined bib and bottle for infants.

2. Description of the Prior Art

Bibs are an indispensable apron like cloth and the like for tying around a child's neck at meals. In the past, bibs have generally served no other function than to act as a barrier for milk or food. During feeding it is obvious that an infant requires a person to hold a bottle or the bottle being held by another support. No past bibs have combined the primary purpose of a bib serving as a shield against liquid as a result of feeding by a bottle with the capability of supporting the bottle. Accordingly, it is desirable in the prior art to provide a bib capable of supporting a bottle during feeding.

SUMMARY OF THE INVENTION

It is, therefore, an objective of the invention to provide a combined bib and bottle holder. The front of the bib herein disclosed is provided with a bottle holder which is capable of supporting and holding bottles of all sizes for feeding to a baby. The infant can be positioned in a manner that the bottle is effectively supported while the child consumes the contents without the aid of another.

DESCRIPTION OF THE PREFERRED EMBODIMENT

Figure 1:
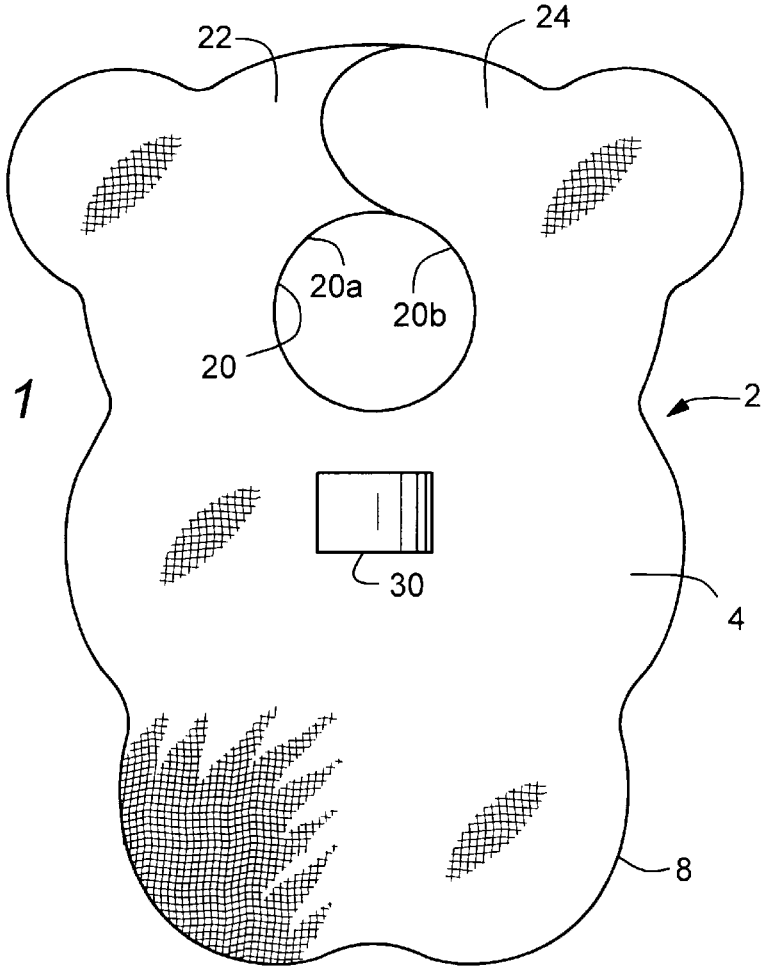
FIG. 1 is a front elevational view of the combined bib and bottle support of the invention.

Referring now to FIGS. 1–4, there is illustrated the combined bib and bottle support of the invention, generally designated by reference numeral 2. The combined bib and bottle support 2 is formed by a front cloth panel 4 and a rear cloth panel 6. The panels 4 and 6 may be formed from any absorbent material, such as, for example, a broadcloth of cotton or blended fabric. Alternatively, at least the front panel 4 can also comprise a liquid repellant material (not shown). As seen in FIG. 1, the exterior periphery 8 of the combined bib and bottle support generally suggests the outline of the configuration of an animal, although other shapes are within the scope of the invention.

Figure 4:
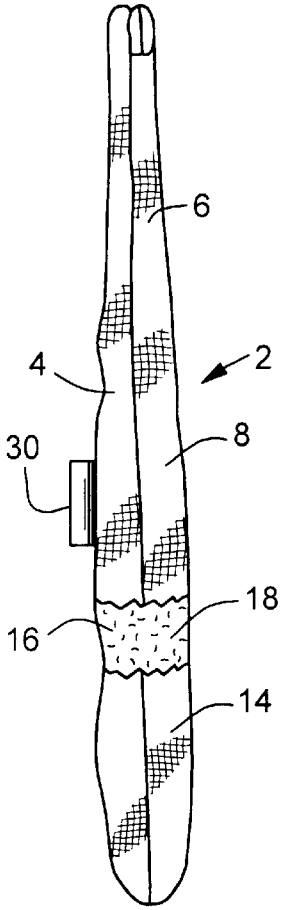
FIG. 4 is a side elevational view of the combined bib and bottle support of FIG. 1.

The front panel 4 and rear panel 6 are continuously sewn together on their outer periphery 8 by suitable threads by upper stitched sections 10*a* and 10*b* (FIG. 2), lower stitched section 12 (FIG. 3) and on two sides at stitched sections 14 (one of which is shown in FIG. 4). The panels 4 and 6 create an interior cavity 16, a portion of which is shown in FIG. 4, in which a soft fabric material 18 or other soft material is retained as an absorbent agent or for providing a soft feel or for providing support and providing a propping means for the bottle as suggested in FIGS. 2 and 4.

Figure 2:
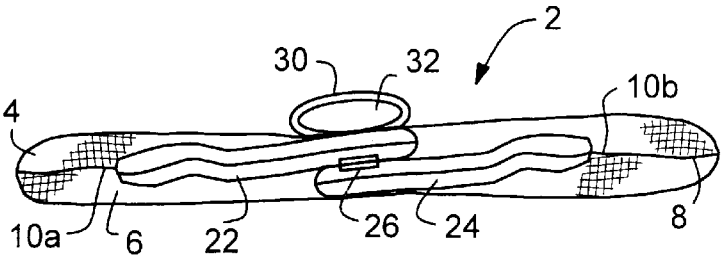
FIG. 2 is a top plan view of the combined bib and bottle support of FIG. 1.
Figure 3:
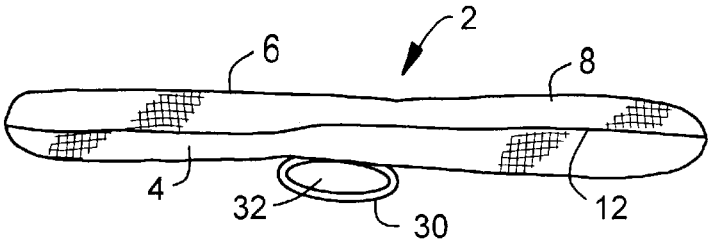
FIG. 3 is a bottom plan view of the combined bib and bottle support of FIG. 1.

A neck hole 20 (FIG. 1) is formed by stitches 20*a* on the panels 4 and 6 and partially defined by two detachable upper end portions 22 and 24 (FIG. 2). The end portions 22 and 24 are extendable tward each other and are secured together around an infant's neck by an interconnecting elements 26 of loops and hooks sold under the trademark VELCRO. To attach or remove the bib, the VELCRO elements 26 are attached or released as desired.

A bottle holder 30 is affixed to front panel 4 by suitable stitching 32 and is in the form of a closed loop. The bottle holder 30 is formed from a suitable, stretchable material, such as an elastic. The elastic material of the bottle holder 30 stretches to surround a range of sizes of baby bottles (not shown) in tight relationship to a bottle in opening 32 for securement and support. The bottle is thus supported for consumption by a baby without requiring support by another. The baby can be fed in accordance with the invention while the parent or other person does other tasks either while the infant is in a seat, in bed, is being held, or under other properly supervised situations.

What is claimed is:

1. A combined bib and bottle support for a child comprising panel means for forming an outer protective surface for the child, said panel means having a pair of upper portions extendible toward each other, said pair of upper portions having attachment elements to releasably secure the pair of upper portions together for securing said panel means for attachment of said panel means to the child, loop means attached to said outer protective surface for supporting a bottle being fed to the child, said loop means being a continuous loop having a portion affixed to said panel means and having opposite open ends, and said continuous loop being wholly formed from an elastic material for resiliently holding the bottle, said elastic material surrounding the bottle for supporting the bottle; said panel means includes a front and a back panel being continuously affixed together along respective portions; a soft material being retained between the front and back panels for creating resiliency and a soft feel and said soft material having a portion adjacent the bottle for propping the bottle.

2. The combined bib and bottle support according to claim 1 wherein said pair of upper portions form from said front and back panel.

3. The combined bib and bottle support according to claim 1 wherein said attachment means are Velcro elements.

4. a soft material being retained between said front and back panels for creating resiliency and a soft feel, said soft material having a portion adjacent the bottle for propping the bottle.

* * * * *